US008136461B2

(12) United States Patent
Leng

(10) Patent No.: US 8,136,461 B2
(45) Date of Patent: Mar. 20, 2012

(54) DESK WHICH HAS COMBINED VERTICAL TYPE LEGS

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 577 days.

(21) Appl. No.: 12/444,070

(22) PCT Filed: Jul. 4, 2005

(86) PCT No.: PCT/CN2005/000971

§ 371 (c)(1),
(2), (4) Date: Apr. 2, 2009

(87) PCT Pub. No.: WO2006/007779

PCT Pub. Date: Jan. 26, 2006

(65) Prior Publication Data

US 2010/0282134 A1 Nov. 11, 2010

(30) Foreign Application Priority Data

Jul. 20, 2004 (CN) ..... 2004 2 0052539 U

(51) Int. Cl.
*A47B 3/06* (2006.01)

(52) U.S. Cl. ..... 108/158; 108/156; 248/188

(58) Field of Classification Search ..... 108/158, 108/158.11, 157.1, 144.11, 147.19; 248/188.4, 248/188

See application file for complete search history.

(56) References Cited

U.S. PATENT DOCUMENTS

| | | | | | |
|---|---|---|---|---|---|
| 797,990 | A * | 8/1905 | Treichel | 108/158 |
| 1,546,777 | A * | 7/1925 | Deinhart | 108/150 |
| 1,942,190 | A * | 1/1934 | Smullin | 108/158 |
| 2,947,556 | A * | 8/1960 | Wenger | 403/290 |
| 2,981,578 | A * | 4/1961 | Saarinen | 108/158 |
| 3,153,524 | A * | 10/1964 | Greenfield et al. | 248/188.7 |
| 3,194,189 | A * | 7/1965 | Bailey | 108/158 |
| 3,208,409 | A * | 9/1965 | Gale | 108/158.11 |
| 3,391,660 | A * | 7/1968 | Stewart | 108/158.11 |
| 3,856,371 | A | 12/1974 | Forsyth | |
| 4,011,821 | A * | 3/1977 | Neal | 108/156 |
| 4,043,278 | A * | 8/1977 | Kessler et al. | 108/158 |
| 4,562,986 | A * | 1/1986 | Frascaroli et al. | 248/188.1 |
| 5,377,601 | A * | 1/1995 | Cashen | 108/158 |
| 5,528,996 | A * | 6/1996 | Edwards et al. | 108/64 |
| 5,560,303 | A * | 10/1996 | Severin | 108/158 |
| 5,934,630 | A * | 8/1999 | Williams et al. | 248/188 |
| 6,478,269 | B2 * | 11/2002 | Forsberg | 248/188.5 |
| 6,484,649 | B1 * | 11/2002 | Wang | 108/158 |
| 2002/0092448 | A1 * | 7/2002 | Park | 108/144.11 |

FOREIGN PATENT DOCUMENTS

| | | |
|---|---|---|
| CN | 2303515 Y | 1/1999 |
| DE | 29800630 U1 | 5/1998 |
| WO | WO-8801145 | 2/1988 |

* cited by examiner

*Primary Examiner* — Jose V Chen
(74) *Attorney, Agent, or Firm* — Rabin & Berdo, P.C.

(57) ABSTRACT

A table includes legs, each of which includes a tube and a long screw rod passing through the tube. The tube has a limit step at a first end. The long screw rod has a protruding step at the first end and a screw at a second end. The table also has a tabletop with screw holes. Each screw hole is for receiving the screw of the long screw rod. The screw is lock-connected with the screw hole when the legs are perpendicularly joined to the tabletop at the second end. The protruding step of the long screw rod engages the limit step of the tube.

18 Claims, 12 Drawing Sheets

DESK WHICH HAS COMBINED VERTICAL TYPE LEGS

FIELD OF THE INVENTION

This invention relates to a kind of desk/table, especially a desk/table with a simple structure, which has combined vertical legs that are easily attachable to/detachable from the desktop.

DESCRIPTION OF THE PRIOR ART

Desk/table is a mostly-used commodity of furniture type in our daily life which can often be seen at home, in office or at various public sites and is indispensable in our life. There are various kinds of desks/tables: office desks/tables used in work and study, desks/tables used for various meetings, small dining tables used at home and large dining tables at restaurants, desks/tables used for recreation and entertainment, computer desks/tables, etc.

As desks/tables can be used for many purposes, a series of designs of desks/tables have emerged. A kind of desk/table used for meetings generally adopts combined vertical legs. It is because the users sit around the desk/table that this kind of leg structure is adopted. If the legs of desk/table are too complex, such as foldable legs of X shape, it will be inconvenient for users' feet to move freely under the desk/table, which will certainly reduce the users' comfort. In addition, the X shape foldable legs are not suitable for supporting a large or rectangle desktop. However, such combined vertical legs have some disadvantages. For example, it is not convenient to fold them. If this kind of legs and the desktop are used as a fixed structure, it will not be easy to store the desk/table as a large store space is needed in this case. On the other hand, it will be difficult to move the desk/table, which will affect the flexibility in using the desk/table. Therefore, the desks/tables are mostly designed to be removable, comprising desktop and legs. However, disadvantages of this kind of desks/tables designed by the prior art lie in either an unstable connection between the desktop and legs or a complex structure that makes the attachment/detachment inconvenient.

SUMMARY OF THE INVENTION

This invention aims to overcome the deficiency of the prior art and to provide a desk/table with combined vertical legs characterized by light weight, simple structure, convenient attachment to/detachment from the desktop for the legs and stable connection between the desktop and legs.

According to the present invention, there is provided a technical solution: a desk/table with combined vertical legs which consists of one desktop and several legs that are connected to the bottom of the desktop in a vertical way; joiners with screw holes are provided at the bottom of the desktop for connecting with the legs; the desk/table legs comprising leg tubes and long screw rods which are inserted in the leg tubes. A protruding step is provided at the first end of each long screw rod and there is a limit step at the corresponding first end of each leg tube. In matching, the protruding step will be blocked by the limit step of each leg tube; male thread is provided on the second end of each long screw rod which passes through the second end of each leg tube and is lock-connected with the screw hole in the desktop bottom to lock tightly the leg tube between the protruding step at the first end of each long screw rod and the corresponding joiner at the desktop bottom. The said desk/table with combined vertical legs consists of one desktop and four legs; the legs are jointed vertically to the four corners of the desktop bottom; joiners with screw holes are provided at four corners of the bottom of the desktop for connecting with the legs; and the legs comprising leg tubes and long screw rods which are inserted in the leg tubes. A protruding step is provided at the first end of each long screw rod and there is a limit step at the corresponding first end of each leg tube. In matching, the protruding step will be blocked by the limit step of each leg tube; male thread is provided on the second end of each long screw rod which passes through the corresponding matching leg tube and is lock-connected with the screw hole at the corresponding one of the four corners in the desktop bottom. The leg tube is locked between the protruding step at the first end of the matching long screw rod and the joiner at the corresponding one of the four corners of the desktop bottom.

The said long screw rod is of single structure of vertical rod shape, with a protruding step provided at one end and male thread at the other end.

The said long screw rod comprises a vertical rod with male thread at both ends and stepped type nuts with female thread. The first end of the long screw rod is formed by tight interlocking of stepped nut with one of the ends of the vertical rod.

The said long screw rod consists of a vertical rod and hexagon head nut and is provided with male thread at both ends of the rod. The first end of the long screw rod is formed by tight interlocking of hexagon head nut with one of the ends of the vertical rod.

The first end limit step of the said leg tubes is provided with a press-embedded leg pad.

The said joiners are the nuts pre-embedded in the desktop bottom.

The first end of the said long screw rod is provided with internal hexagon.

The said leg tube is of circular sectional shape and is provided with a build-in plug at its second end which has an opening facing towards the horn of the first end of the leg tube.

The said leg tube is of non-circular sectional shape and is provided with a build-in plug at its second end which has an opening facing towards the horn of the first end of the leg tube. The build-in plug of the leg tube is provided with a boss on the side facing the desktop and there is a groove in the joiner of the desktop bottom at the corresponding position. In matching, the boss of the leg tube will be pressed into the groove in the desktop bottom.

When the desk/table is to be assembled for use, first insert all long screw rods into the corresponding leg tubes. During the insertion, take the second end of the long screw rod that has male thread and insert it along the first end of the leg tube into the chamber of the leg tube. When coming to the second end of the leg tube, the second end of the long screw rod will meet with the plug at this end of the leg tube. As the plug is provided with an opening facing towards the horn at the first end of the leg tube, i.e. the large opening of the horn faces towards the first end of the leg tube and the small opening is near the joint point of the desktop, the second end of the long screw rod can smoothly pass through the leg tube and locate at the middle of the chamber of the leg tube, enabling an easy and precise insertion of the long screw rod into the screw hole in the desktop bottom. Turn the long screw rod to screw the male thread of the second end of the rod into the screw hole at the desktop bottom. When it is tightly locked, the protruding step of the first end of the rod will be mutually blocked with the limit step at the first end of the leg tube, thus locking tightly the leg tube between the protruding step of the first end of the rod and the joiner of the desktop bottom. Now, a mutual fixing between the rod, the leg tube and the desktop bottom is achieved and the desk/table can be used after the fixing of all the legs with the desktop. The installation and connection process of this kind of desk/table is extremely convenient and rapid and results in a firm connection between the legs and the desktop.

To detach the desk/table, you need only to screw out the second end of the long screw rod of each leg from the screw hole in the desktop bottom, realizing the detachment of the desktop and the legs. The detachment process of this kind of desk/table is extremely convenient and rapid. When detached, it is convenient to store or transport the desk/table top and the legs.

The beneficial effect of this invention lies in that: as the desktop bottom is provided with a joiner with a screw hole for connecting itself with the legs, the desk/table legs comprising leg tubes and long screw rods which are inserted in the leg tubes, the first end of the rod is provided with a protruding step and there is a limit step at the first end of the corresponding leg tube, the protruding step of the rod will be mutually blocked with the limit step of the leg tube in matching, and the second end of the rod provided with male thread passes through the middle of the tube chamber and is mutually locked with the screw hole in the desktop bottom, making the integral structure of the desk/table very simple, the attachment or detachment of legs and tabletop to/from the desk/table are therefore very convenient by only screwing the threaded end of the rod into the screw hole of the desktop in attachment and screwing the threaded end of the rod out of the screw hole of the desktop in detachment, and the legs and the desktop can be securely connected; as the matching of the protruding step of the long screw rod and the limit step of the leg tube is adopted and the protruding step of the rod can be formed by integral processing or by the interlocking between the stepped nut or hexagon nut and the vertical rod end, the parts are easy to be processed and formed; as a build-in plug is provided in the leg tube at one end that is to be locked to the desktop bottom and the plug is provided with a horn with the opening facing towards the leg tube bottom, the assembling of the long screw rod is made very convenient and the rod can be easily and accurately led into the screw hole in the desktop bottom; as a boss is provided on the build-in plug of the leg tube on the side facing the desktop and a groove in the joiner of the desktop bottom at the corresponding place, the leg tube can be located at the required position and as the leg tubes in this invention are not directly connected with the desktop, the connecting screw thread is less likely to loosen in the desk/table in use.

BRIEF DESCRIPTION OF THE DRAWINGS

Hereinafter, the present invention will be described by way of illustrative examples with reference to the accompanying drawings, but this invention of a kind of combined vertical legs is not limited to these embodiments.

DESCRIPTION OF THE PREFERRED EMBODIMENTS

Figure 1:
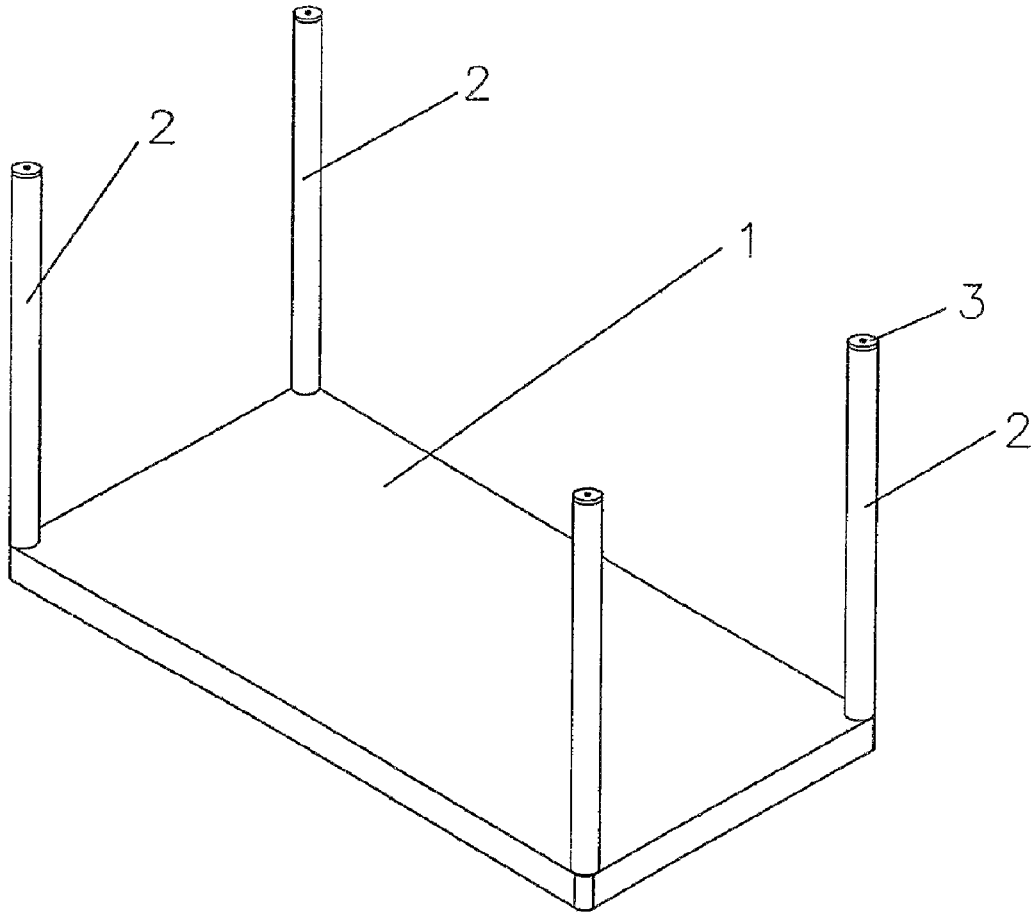
FIG. 1 is the spatial structure drawing of Embodiment 1 of this invention.
Figure 2:
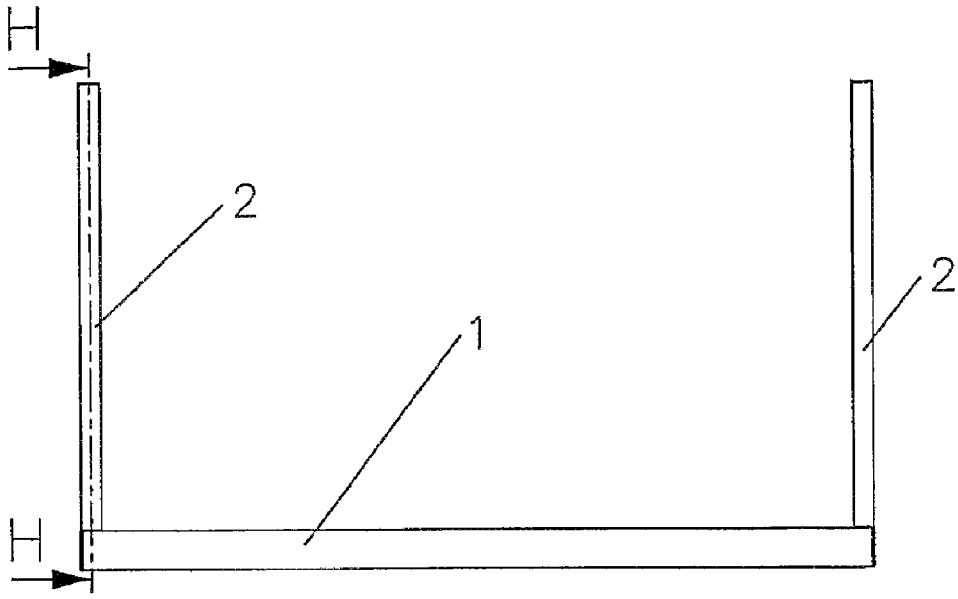
FIG. 2 is the front-view drawing of Embodiment 1 of this invention.
Figure 3:
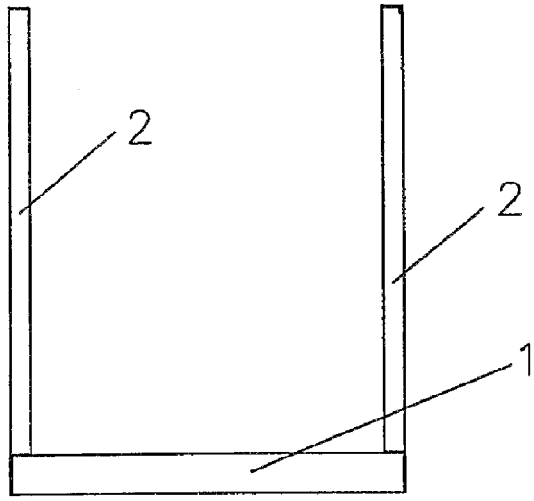
FIG. 3 is the side-view drawing of Embodiment 1 of this invention.
Figure 4:
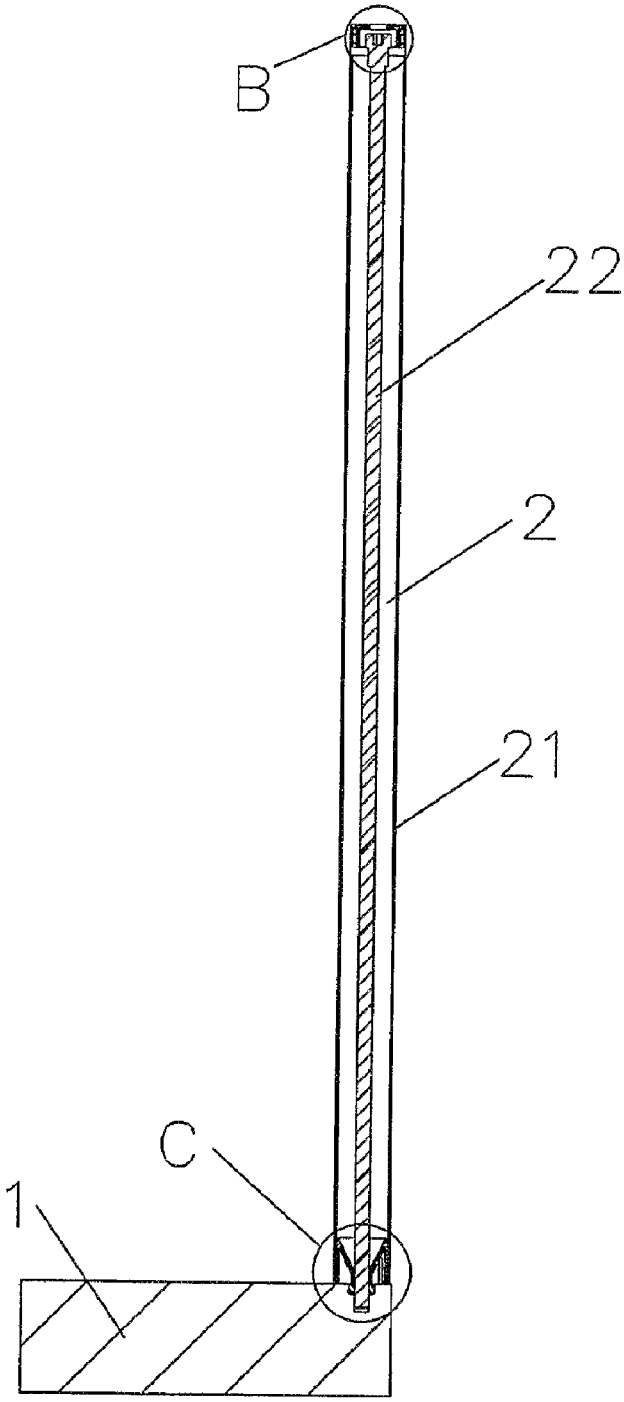
FIG. 4 is the sectional view along H-H line in FIG. 2.
Figure 5:
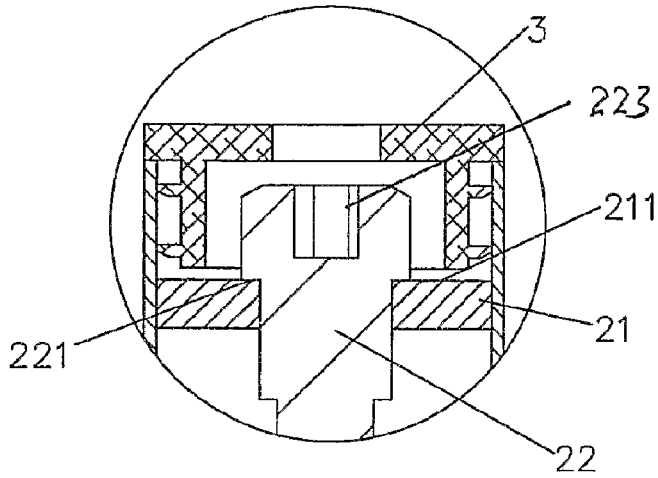
FIG. 5 is the enlarged partial view drawing of B part in FIG. 4.
Figure 6:
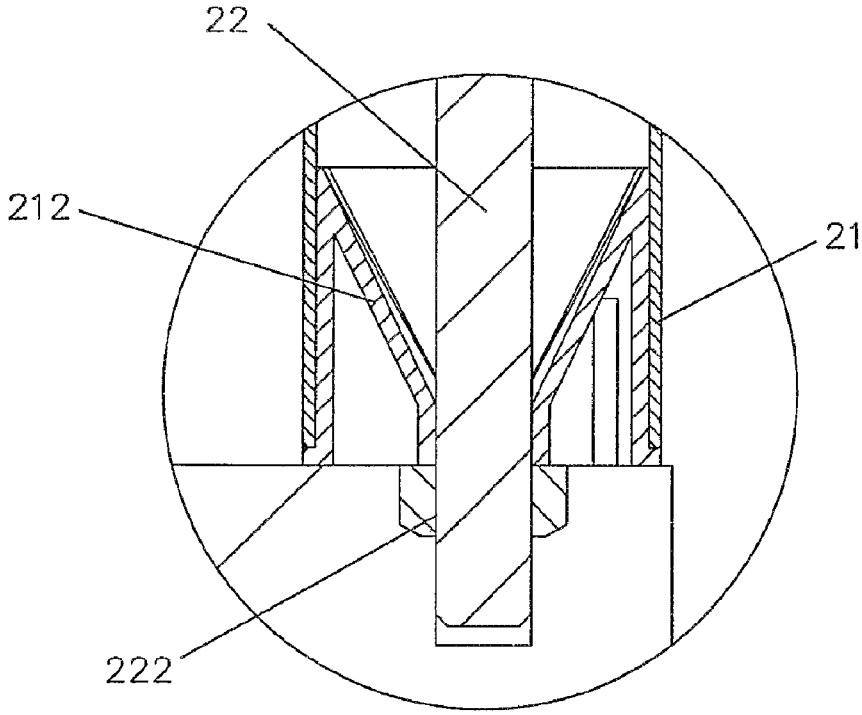
FIG. 6 is the enlarged partial view drawing of C part in FIG. 4.
Figure 7:
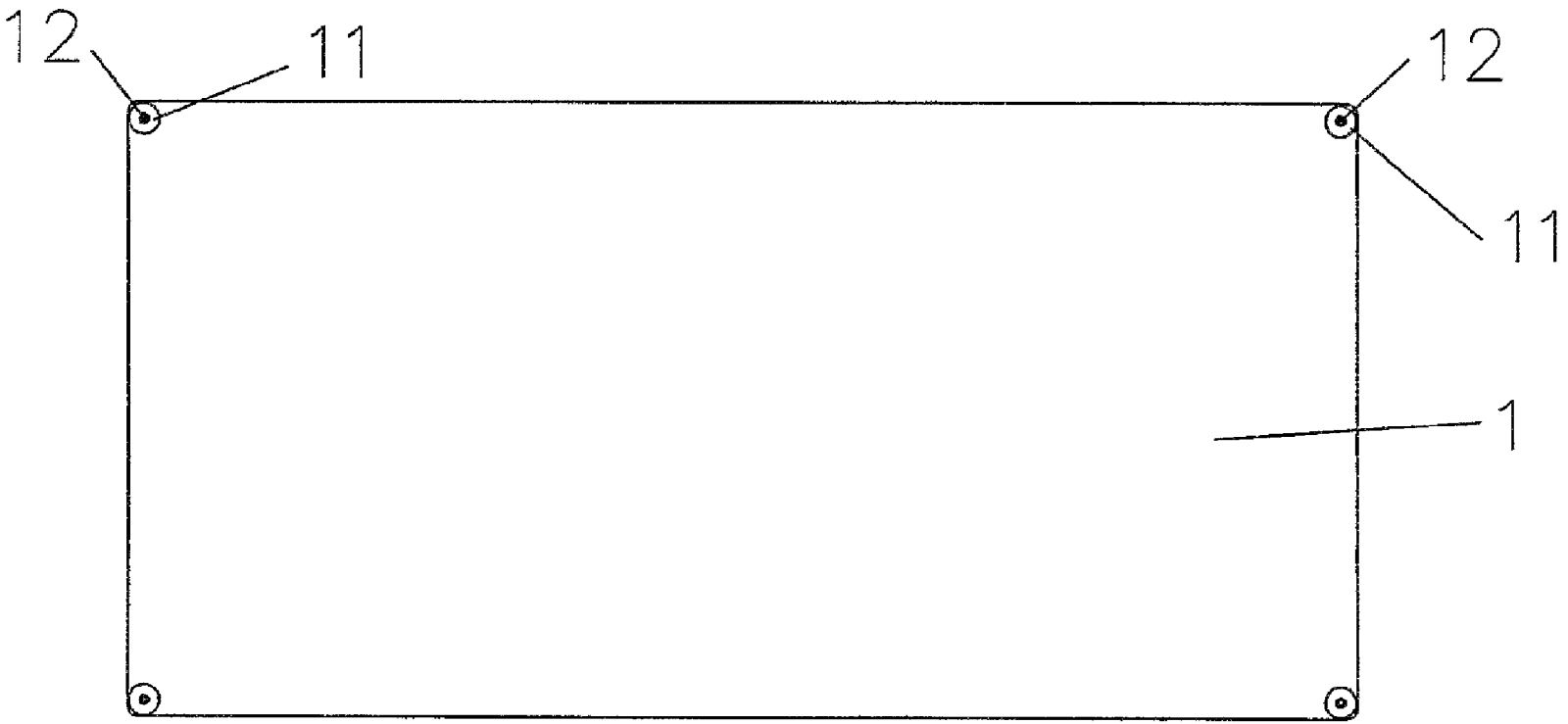
FIG. 7 is the bottom-view drawing of the desktop in Embodiment 1 of this invention.

Embodiment 1, refer to FIGS. 1 to 7: The desk/table with combined vertical legs of this invention consists of one desktop 1 and four legs 2; the legs 2 are jointed to the four corners of the bottom of desktop 1 in a vertical way;

joiners 11 are provided at four corners of the bottom of the desktop 1 for connecting the desktop 1 with the legs; and the joiners 11 in this embodiment are the nuts that are provided with screw holes 12 and pre-embedded in the bottom of the desktop 1;

the legs 2 comprising leg tubes 21 and long screw rods 22: the first end of the rod 22 is provided with a protruding step 221, the second end of the rod 22 is provided with male thread 222 and the first end inner surface is provided with internal hexagon 223;

the leg tubes 21 are tubes of circular sectional shape, the long screw rods 22 are inserted in the leg tubes 21, a protruding step 221 is provided at the first end of each long screw rod 22 and there is a limit step (a rib) 211 at the corresponding first end of each leg tube 21; in matching, the protruding step 221 will be blocked by the limit step 211 of each leg tube 22; male thread 222 is provided on the second end of each long screw rod 22, the second end of the leg tube 21 is provided with a horn-shaped plug 212 which is provided with a horn with an opening facing the first end of the leg tube 21; the second end of each rod 22 passes through the second end of the corresponding leg tube 21 and lock-connected with the corresponding screw hole 12 at one of the four corners of the bottom of the desktop 1, each leg tube 21 is locked between the protruding step 221 of the first end of the corresponding rod 22 and the joiner 11 at one of the four corners of the bottom of the desktop 1 and there is a pad 3 press-embedded in the first end of each leg tub 21.

When the desk/table is to be assembled for use, first insert all long screw rods 22 into the corresponding leg tubes 21. During the insertion, take the second end that has male thread 222 of the long screw rod 22 and insert it along the first end of the leg tube 21 into the chamber of the leg tube 21. When coming to the second end of the leg tube 21, the second end of the long screw rod 22 will meet with the plug 212 at this end of the leg tube 21. As the plug 212 is provided with an opening facing towards the horn at the first end of the leg tube 21, i.e. the large opening of the horn faces towards the first end of the leg tube 21 and the small opening is near the joint point of the desktop 1, the second end of the long screw rod 22 can smoothly pass through the leg tube 21 and locate at the middle of the chamber of the leg tube 21, enabling an easy and precise insertion of the long screw rod 22 into the screw hole 12 in the desktop 1 bottom. Turn the long screw rod 22 to screw the male thread 222 of the second end of the rod into the screw hole 12 at the desktop 1 bottom. When it is tightly locked, the protruding step 221 of the first end of the rod 22 will be mutually blocked with the limit step 211 at the first end of the leg tube 21, thus locking tightly the leg tube 21 between the protruding step of the first end of the rod 22 and the joiner 11 of the desktop 1 bottom. Now, a mutual fixing between the rod 22, the leg tube 21 and the desktop 1 bottom is achieved and the desk/table can be used after the fixing of all the legs with the desktop 1. The installation and connection process of this kind of desk/table is extremely convenient and rapid and results in a firm connection between the legs and the desktop.

To detach the desk/table, first pull out the pad (tube cover) 3 from the first end of the leg tube 21 and then screw out the second end of the long screw rod 22 of each leg from the screw hole 12 in the bottom of the desktop 1 through the internal hexagon 223 in the first end surface of the rod 22, thus realizing the detachment of the desktop from the legs. The detachment process of this kind of desk/table is extremely convenient and rapid. When detached, it is convenient to store or transport the desk/table top and the legs.

Figure 8:
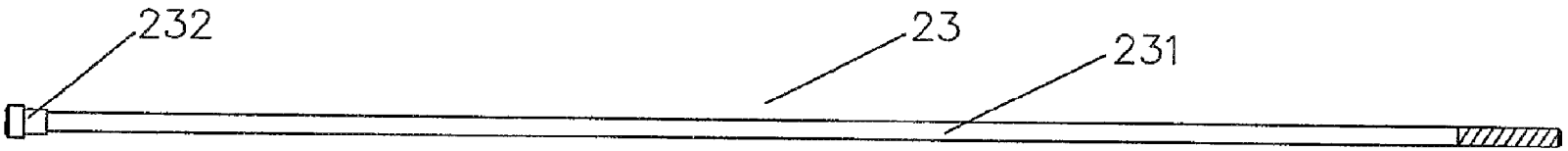
FIG. 8 is the structure drawing of the long screw rod in Embodiment 2 of this invention.
Figure 9:
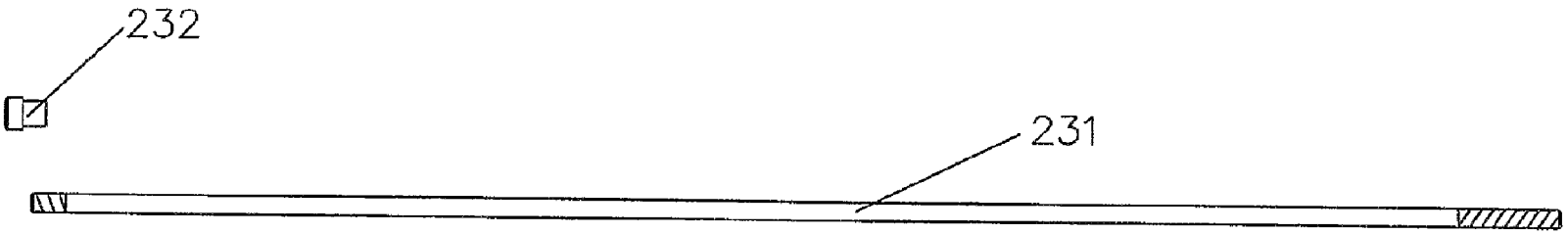
FIG. 9 is the exploded view drawing of the long screw rod in Embodiment 2 of this invention.

Embodiment 2, refer to FIGS. 8 and 9: It is a desk/table with combined vertical legs of this invention, which is different from Embodiment 1 in that the long screw rod 23 consists of a vertical rod 231 and stepped nut 232 with female thread, with both ends of the rod 231 being provided with male thread and the first end being formed by the lock-matching between the stepped nut 232 and one of the ends of the vertical rod 231.

Figure 10:
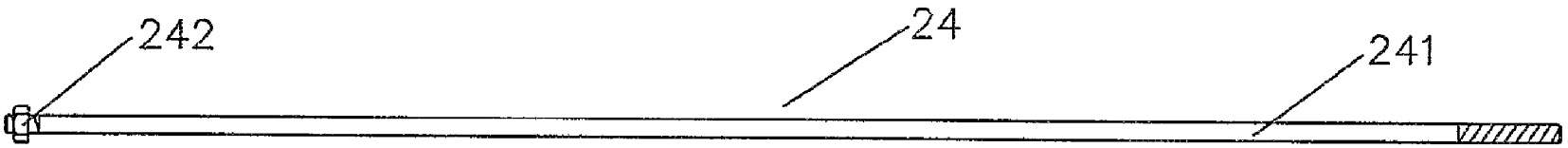
FIG. 10 is the structure drawing of the long screw rod in Embodiment 3 of this invention.
Figure 11:
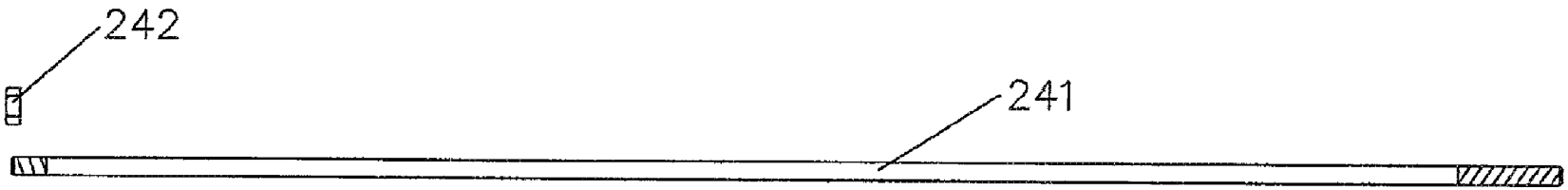
FIG. 11 is the exploded view drawing of the long screw rod in Embodiment 3 of this invention.
Figure 12:
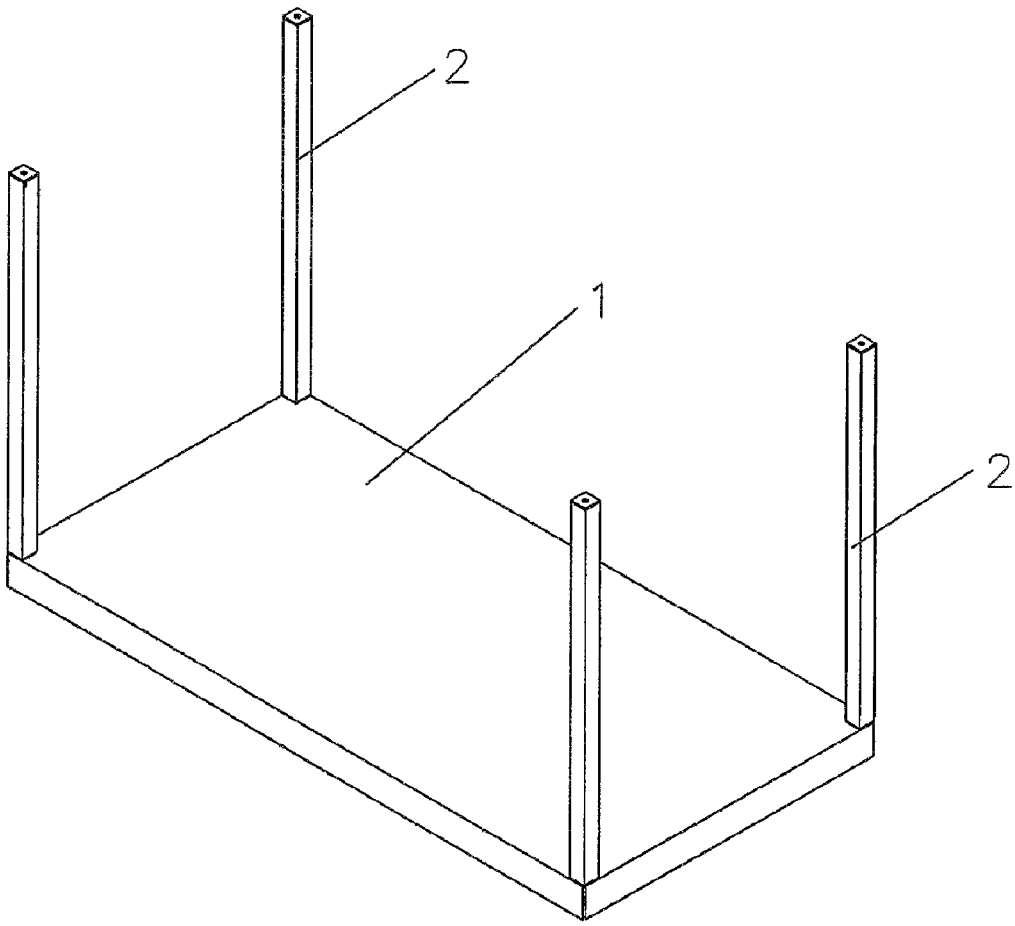
FIG. 12 is the spatial structure drawing of Embodiment 4 of this invention.
Figure 13:
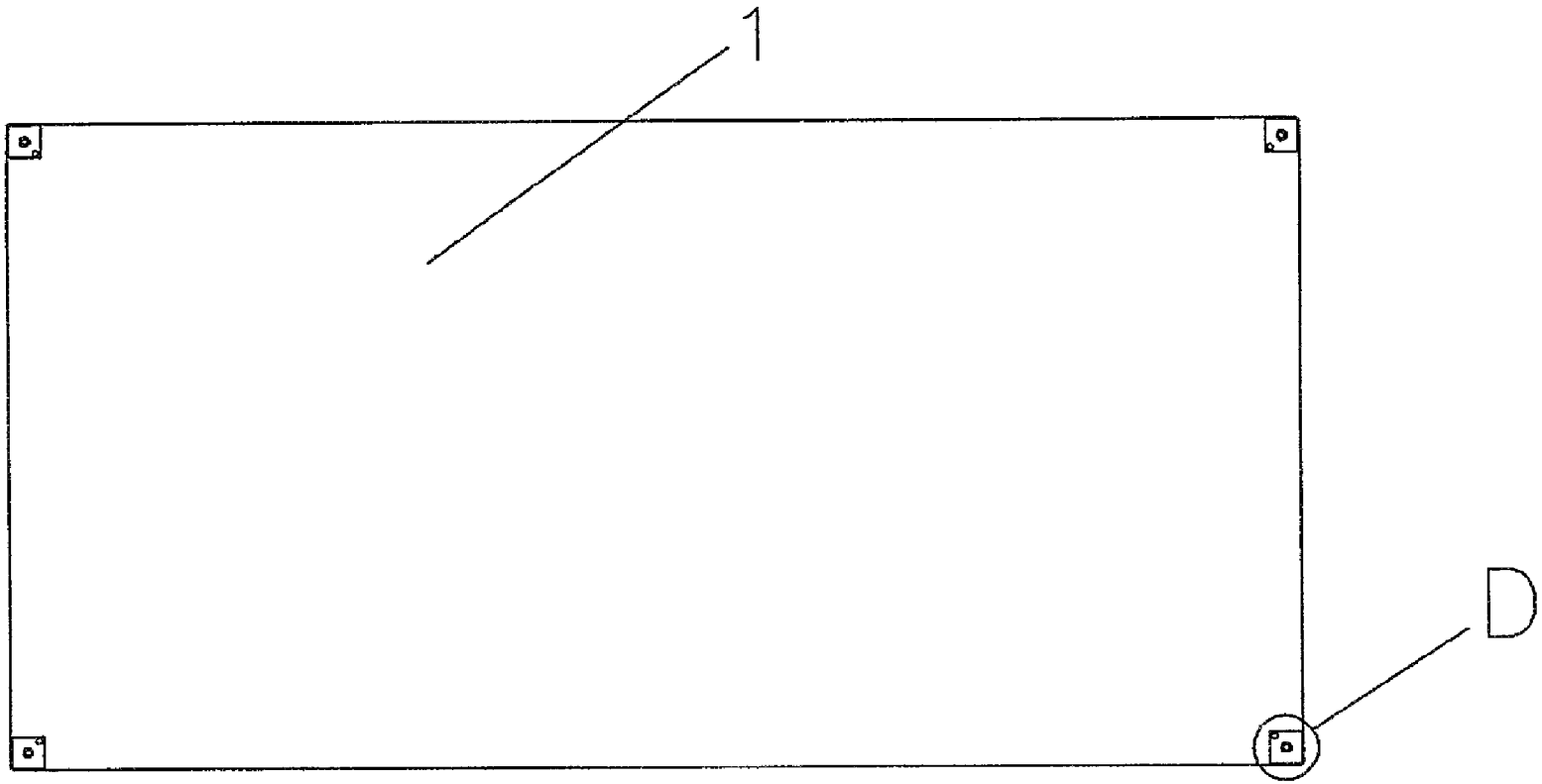
FIG. 13 is the bottom-view drawing of the desktop in Embodiment 4 of this to invention.
Figure 14:
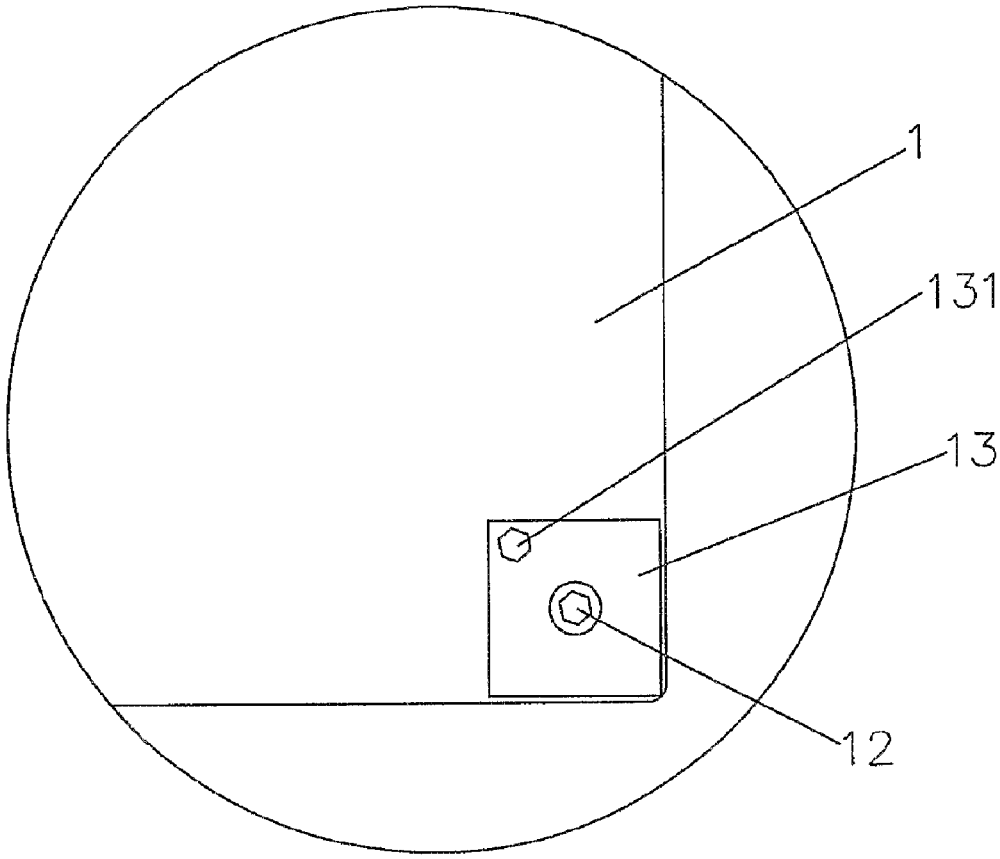
FIG. 14 is the enlarged partial view drawing of D part in FIG. 13.
Figure 15:
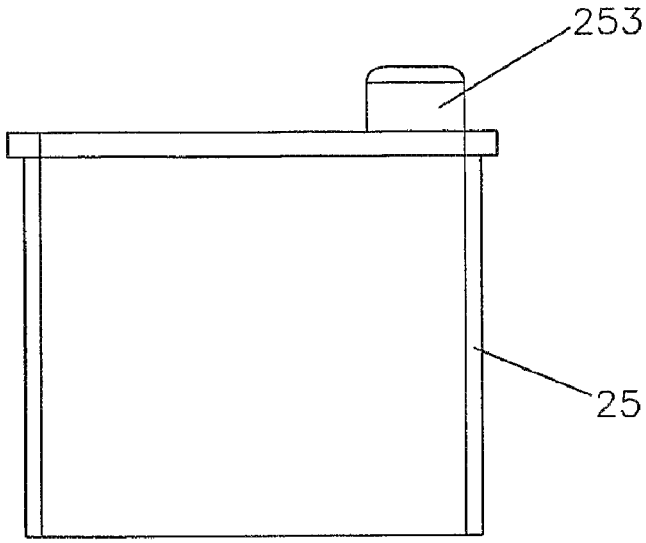
FIG. 15 is the front-view drawing of the second end of the long screw rod in Embodiment 4 of this invention.
Figure 16:
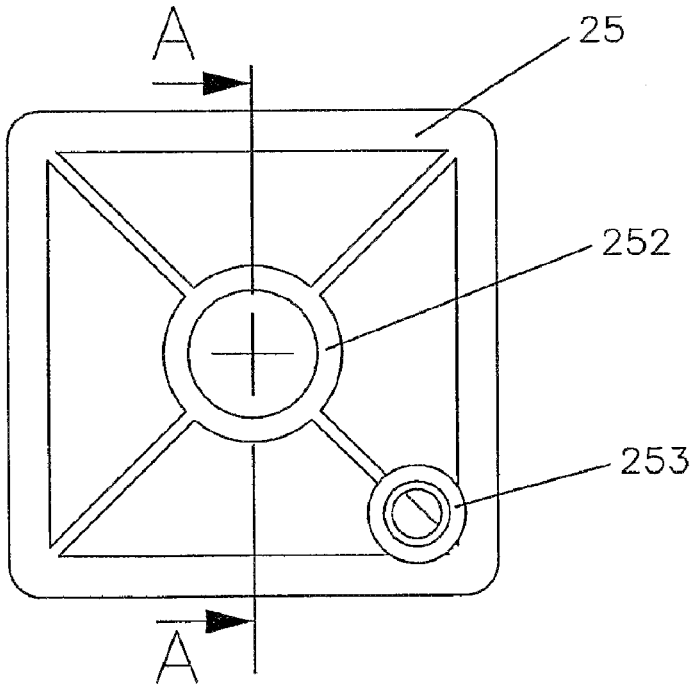
FIG. 16 is the top-view drawing of the second end of the long screw rod in Embodiment 4 of this invention.
Figure 17:
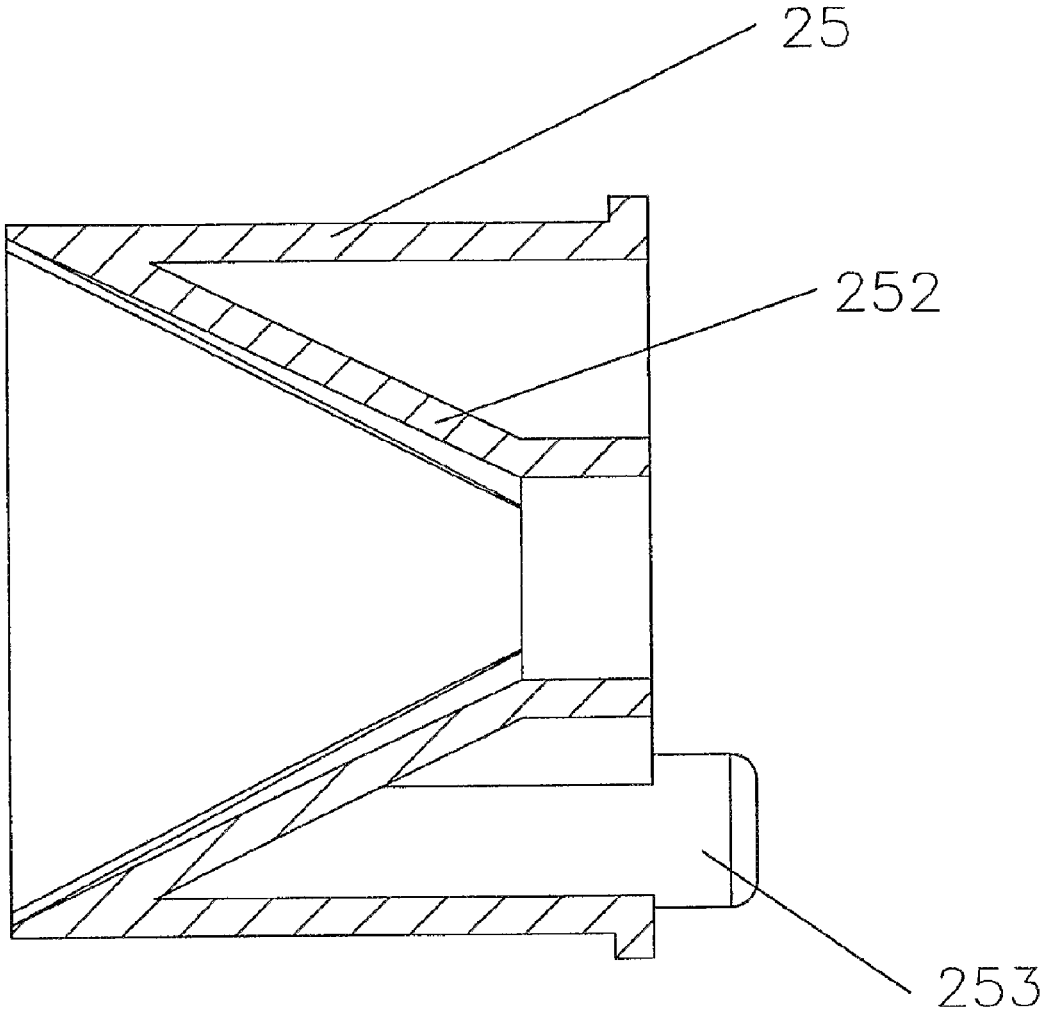
FIG. 17 is the sectional view along A-A line in FIG. 16

Embodiment 3, refer to FIGS. 10 and 11: It is a desk/table with combined vertical legs of this invention which is different from Embodiment 1 in that the long screw rod 24 consists of a vertical rod 241 with both ends being provided with male thread and a hexagon head nut 242, and the first end of the rod 24 is formed by the lock-matching between the hexagon head nut 242 and one of the ends of the vertical rod 241.

Embodiment 4, refer to FIGS. 12 to 17: It is a desk/table with combined vertical legs of this invention which is different from Embodiment 1 in that the leg tubes 25 are of non-circular sectional shape and are provided with a build-in plug 252 which has an opening facing towards the horn of the first end of the leg tube. The build-in plug 252 of the leg tube 25 is provided with a boss 253 on the side facing the desktop and there is a groove 131 in the joiner 13 of the bottom of the desktop 1 at the corresponding position. In matching, the boss 253 of the leg tube 25 will be pressed into the groove 131 in the bottom of the desktop 1.

INDUSTRIAL PRACTICABILITY

As the legs of the desk/table with combined vertical legs of this invention comprising a set of leg tubes 25 and long screw rods 24, the desk/table is convenient to install and safe in use. All parts of this invention can be industrially produced on a large scale and therefore, this invention has good industrial practicability.

The invention claimed is:

1. A table comprising:

a plurality of legs, each of the plurality of legs comprising:

a tube having a rib disposed on an inner periphery of a wall of the tube at a first end;

a long screw rod passing through the tube, the long screw rod having a stepped head at a first end thereof and a screw at a second end thereof;

a tube cover for covering the first end of the tube; and a horn shaped plug disposed in the tube at a second end thereof, for facilitating an insertion of the screw of the long screw rod into a screw hole; and a tabletop with a plurality of screw holes, each of the plurality of screw holes for receiving the screw of the long screw rod;

wherein the screw is lock-connected with the screw hole when each the plurality of the legs is perpendicularly joined to the tabletop at the second end of the tube, and the stepped head of the long screw rod engages the rib of the tube; wherein the stepped head of the long screw rod is sunken in the tube and covered by the tube cover.

2. The table according to claim 1, wherein the tabletop is rectangle and the table has four legs, and wherein the four legs are at the corners of the tabletop.

3. The table according to claim 1, wherein the table is a desk.

4. The table according to claim 1, wherein the stepped head comprises a second screw at the first end of the long screw rod and a stepped nut.

5. The table according to claim 1, wherein the stepped head comprises a second screw at the first end of the long screw rod and a hexagon nut.

6. The table according to claim 1, wherein the tube has a circular cross-section.

7. The table according to claim 1, wherein the tube has a non-circular cross-section.

8. The table according to claim 1, wherein the tube further comprises a boss for engaging a groove in the tabletop.

9. The table according to claim 1, wherein the leg further comprises a pad at the first end.

10. The table according to claim 1, wherein the screw hole comprises a nut pre-embedded in the tabletop.

11. The table according to claim 1, wherein the stepped head of the long screw rod comprises an internal hexagon.

12. A table leg for use with a tabletop with a screw hole, the table leg comprising:

a tube having a rib disposed on an inner periphery of a wall of the tube at a first end;

a long screw rod passing through the tube, the long screw rod having a stepped head at a first end thereof and a screw at a second end thereof; and a horn shaped plug disposed in the tube at a second end thereof, for facilitating an insertion of the screw of the long screw rod into a screw hole;

wherein the screw is lock-connected with the screw hole when the table leg is joined at the second end of the tube, and the stepped head of the long screw rod engages the rib of the tube.

13. The table leg according to claim 12, wherein the stepped head comprises a second screw at the first end of the long screw rod and a stepped nut.

14. The table leg according to claim 12, wherein the stepped head comprises a second screw at the first end of the long screw rod and a hexagon nut.

15. The table leg according to claim 12, wherein the tube has a circular cross-section.

16. The table leg according to claim 12, wherein the tube has a non-circular cross-section.

17. The table leg according to claim 12, wherein the screw hole comprises a nut.

18. The table leg according to claim 12, wherein the stepped head of the long screw rod comprises an internal hexagon.

* * * * *